US010497375B2

(12) United States Patent
Kastner et al.

(10) Patent No.: US 10,497,375 B2
(45) Date of Patent: Dec. 3, 2019

(54) APPARATUS AND METHODS FOR ADAPTING AUDIO INFORMATION IN SPATIAL AUDIO OBJECT CODING

(71) Applicant: Fraunhofer-Gesellschaft zur Foerderung der angewandten Forschung e.V., Munich (DE)

(72) Inventors: Thorsten Kastner, Erlangen (DE); Juergen Herre, Erlangen (DE); Leon Terentiv, Erlangen (DE); Oliver Hellmuth, Erlangen (DE); Jouni Paulus, Erlangen (DE); Falko Ridderbusch, Erlangen (DE)

(73) Assignee: Fraunhofer—Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/616,374

(22) Filed: Feb. 6, 2015

(65) Prior Publication Data

US 2015/0154968 A1 Jun. 4, 2015

Related U.S. Application Data

(63) Continuation of application No. PCT/EP2013/063703, filed on Jun. 28, 2013.
(Continued)

(51) Int. Cl.
*G10L 19/008* (2013.01)
*G10L 19/16* (2013.01)

(52) U.S. Cl.
CPC ..... *G10L 19/008* (2013.01); *G10L 19/173* (2013.01); *H04S 2420/03* (2013.01)

(58) Field of Classification Search
CPC ..... G10L 19/008; H04S 3/00; H04S 3/008
(Continued)

(56) References Cited

U.S. PATENT DOCUMENTS

2008/0008323 A1 1/2008 Hilpert et al.
2008/0049943 A1* 2/2008 Faller ..... G10L 19/008 381/17

(Continued)

FOREIGN PATENT DOCUMENTS

CN 101479785 A 7/2009
CN 101529504 A 9/2009

(Continued)

OTHER PUBLICATIONS

Engdegard, J. et al., "Spatial audio object coding (SAOC) the upcoming MPEG standard on parametric object based audio coding", 124th AES Convention, AES Convention Paper 7377, Amsterdam, The Netherlands, May 17-20, 2008, 15 pages.

(Continued)

*Primary Examiner* — Michael N Opsasnick
(74) *Attorney, Agent, or Firm* — Perkins Coie LLP; Michael A. Glenn

(57) ABSTRACT

An apparatus for adapting input audio information, encoding one or more audio objects, to obtain adapted audio information is provided. The input audio information includes two or more input audio downmix channels and further includes input parametric side information. The adapted audio information includes one or more adapted audio downmix channels and further includes adapted parametric side information. The apparatus includes a downmix signal modifier for adapting, depending on adaptation information, the two or more input audio downmix channels to obtain the one or more adapted audio downmix channels. Moreover, the apparatus includes a parametric side information adapter (Continued)

for adapting, depending on the adaptation information, the input parametric side information to obtain the adapted parametric side information.

13 Claims, 9 Drawing Sheets

Related U.S. Application Data

(60) Provisional application No. 61/681,732, filed on Aug. 10, 2012.

(58) Field of Classification Search
USPC ..... 704/500–504
See application file for complete search history.

(56) References Cited

U.S. PATENT DOCUMENTS

| | | | | |
|---|---|---|---|---|
| 2008/0130904 | A1* | 6/2008 | Faller | G10L 19/008 381/17 |
| 2009/0067634 | A1* | 3/2009 | Oh | H04S 3/008 381/17 |
| 2010/0014692 | A1* | 1/2010 | Schreiner | H04S 3/008 381/119 |
| 2011/0013790 | A1 | 1/2011 | Hilpert et al. | |
| 2011/0022402 | A1* | 1/2011 | Engdegard | H04S 7/30 704/501 |
| 2011/0029113 | A1 | 2/2011 | Ishikawa et al. | |
| 2011/0196685 | A1 | 8/2011 | Kim et al. | |
| 2011/0200197 | A1 | 8/2011 | Kim et al. | |
| 2011/0202355 | A1* | 8/2011 | Grill | G10L 19/18 704/500 |
| 2011/0238425 | A1* | 9/2011 | Neuendorf | G10L 19/008 704/500 |
| 2012/0143613 | A1 | 6/2012 | Herre et al. | |
| 2012/0177204 | A1* | 7/2012 | Hellmuth | G10L 19/008 381/22 |

FOREIGN PATENT DOCUMENTS

| | | | |
|---|---|---|---|
| CN | 101542596 | A | 9/2009 |
| JP | 2010507115 | A | 3/2010 |
| JP | 2012525600 | A | 10/2012 |
| KR | 1020090030323 | A | 3/2009 |
| KR | 20120068033 | A | 6/2012 |
| RU | 2406164 | C2 | 12/2010 |
| WO | 2008100100 | A1 | 8/2008 |
| WO | 2011045409 | A1 | 4/2011 |

OTHER PUBLICATIONS

Faller, et al., "Binaural Cue Coding—Part II: Schemes and Applications", IEEE Transactions on Speech and Audio Processing, vol. 11, No. 6, Nov. 2003, pp. 520-531.

Faller, C , ""Parametric Joint Coding of Audio Sources,"", Convention Paper 6752, 120th AES Convention, Paris, May 2006.

Girin, et al., "Informed audio source separation from compressed linear stereo mixtures", HAL; AES 42nd Int'l Conf. on Semantic Audio, Ilmenau, Germany, Jul. 2011, 11 pages.

Liutkus, et al., "Informed source separation through spectrogram coding and data embedding", HAL; Signal Processing Journal, Jul. 2011, 31 pages.

Ozerov, et al., "Informed source separation: source coding meets source separation", IEEE Workshop on Applications of Signal Processing to Audio and Acoustics; Mohonk, NY, Oct. 2011, 5 pages.

Parvaix, et al., "Informed Source Separation of underdetermined instantaneous Stereo Mixtures using Source Index Embedding", IEEE ICASSP, 2010.

Parvaix, M. et al., "A watermarking-based method for informed source separation of audio signals with a single sensor", HAL; IEEE Transactions on Audio, Speech, and Language Processing, vol. 8, Issue 6, Aug. 2010, 12 pages.

Zhang, S. et al., "An Informed Audio Source Separation System for Speech Signals", INTERSPEECH 2011.

Herre, J. et al., "From SAC to SAOC—Recent Developments in Parametric Coding of Spatial Audio", 22nd Regional UK AES Conference, Cambridge, UK, Apr. 2007.

ISO/IEC, "23003-1:2007, MPEG-D (MPEG audio technologies), Part 1: MPEG Surround, 2007".

ISO/IEC, "MPEG audio technologies—Part 2: Spatial Audio Object Coding (SAOC)", ISO/IEC JTC1/SC29/WG11 (MPEG) International Standard 23003-2.

* cited by examiner

APPARATUS AND METHODS FOR ADAPTING AUDIO INFORMATION IN SPATIAL AUDIO OBJECT CODING

CROSS-REFERENCE TO RELATED APPLICATIONS

This application is a continuation of copending International Application No. PCT/EP2013/063703, filed Jun. 28, 2013, which is incorporated herein by reference in its entirety, and additionally claims priority from U.S. Application No. 61/681,732, filed Aug. 10, 2012, which is also incorporated herein by reference in its entirety.

BACKGROUND OF THE INVENTION

The present invention relates to audio signal decoding and audio signal processing, and, in particular, to a decoder and methods for adapting audio information in spatial-audio-object-coding (SAOC).

In modern digital audio systems, it is a major trend to allow for audio-object related modifications of the transmitted content on the receiver side. These modifications include gain modifications of selected parts of the audio signal and/or spatial re-positioning of dedicated audio objects in case of multi-channel playback via spatially distributed speakers. This may be achieved by individually delivering different parts of the audio content to the different speakers.

In other words, in the art of audio processing, audio transmission, and audio storage, there is an increasing desire to allow for user interaction on object-oriented audio content playback and also a demand to utilize the extended possibilities of multi-channel playback to individually render audio contents or parts thereof in order to improve the hearing impression. By this, the usage of multi-channel audio content brings along significant improvements for the user. For example, a three-dimensional hearing impression can be obtained, which brings along an improved user satisfaction in entertainment applications. However, multi-channel audio content is also useful in professional environments, for example, in telephone conferencing applications, because the talker intelligibility can be improved by using a multi-channel audio playback. Another possible application is to offer to a listener of a musical piece to individually adjust playback level and/or spatial position of different parts (also termed as "audio objects") or tracks, such as a vocal part or different instruments. The user may perform such an adjustment for reasons of personal taste, for easier transcribing one or more part(s) from the musical piece, educational purposes, karaoke, rehearsal, etc.

The straightforward discrete transmission of all digital multi-channel or multi-object audio content, e.g., in the form of pulse code modulation (PCM) data or even compressed audio formats, demands very high bitrates. However, it is also desirable to transmit and store audio data in a bitrate efficient way. Therefore, one is willing to accept a reasonable tradeoff between audio quality and bitrate requirements in order to avoid an excessive resource load caused by multi-channel/multi-object applications.

Recently, in the field of audio coding, parametric techniques for the bitrate-efficient transmission/storage of multi-channel/multi-object audio signals have been introduced by, e.g., the Moving Picture Experts Group (MPEG) and others. One example is MPEG Surround (MPS) as a channel oriented approach [MPS, BCC], or MPEG Spatial Audio Object Coding (SAOC) as an object oriented approach [JSC, SAOC, SAOC1, SAOC2]. Another object-oriented approach is termed as "informed source separation" [ISS1, ISS2, ISS3, ISS4, ISS5, ISS6]. These techniques aim at reconstructing a desired output audio scene or a desired audio source object on the basis of a downmix of channels/objects and additional side information describing the transmitted/stored audio scene and/or the audio source objects in the audio scene.

The estimation and the application of channel/object related side information in such systems is done in a time-frequency selective manner. Therefore, such systems employ time-frequency transforms such as the Discrete Fourier Transform (DFT), the Short Time Fourier Transform (STFT) or filter banks like Quadrature Mirror Filter (QMF) banks, etc. The basic principle of such systems is depicted in FIG. 3, using the example of MPEG SAOC.

In case of the STFT, the temporal dimension is represented by the time-block number and the spectral dimension is captured by the spectral coefficient ("bin") number. In case of QMF, the temporal dimension is represented by the time-slot number and the spectral dimension is captured by the sub-band number. If the spectral resolution of the QMF is improved by subsequent application of a second filter stage, the entire filter bank is termed hybrid QMF and the fine resolution sub-bands are termed hybrid sub-bands.

As already mentioned above, in SAOC the general processing is carried out in a time-frequency selective way and can be described as follows within each frequency band, as depicted in FIG. 3:

- N input audio object signals $s_1 \ldots s_N$ are mixed down to P channels $x_1 \ldots x_P$ as part of the encoder processing using a downmix matrix consisting of the elements $d_{1,1} \ldots d_{N,P}$. In addition, the encoder extracts side information describing the characteristics of the input audio objects (side-information-estimator (SIE) module). For MPEG SAOC, the relations of the object powers w.r.t. each other are the most basic form of such a side information.
- Downmix signal(s) and side information are transmitted/stored. To this end, the downmix audio signal(s) may be compressed, e.g., using well-known perceptual audio coders such MPEG-1/2 Layer II or III (aka .mp3), MPEG-2/4 Advanced Audio Coding (AAC) etc.
- On the receiving end, the decoder conceptually tries to restore the original object signals ("object separation") from the (decoded) downmix signals using the transmitted side information. These approximated object signals $\hat{s}_1 \ldots \hat{s}_N$ are then mixed into a target scene represented by M audio output channels $\hat{y}_1 \ldots \hat{y}_M$ using a rendering matrix described by the coefficients $r_{1,1} \ldots r_{N,M}$ in FIG. 3. The desired target scene may be, in the extreme case, the rendering of only one source signal out of the mixture (source separation scenario), but also any other arbitrary acoustic scene consisting of the objects transmitted. For example, the output can be a single-channel, a 2-channel stereo or 5.1 multi-channel target scene.

FIG. 6 schematically depicts the principle of an audio encoding/decoding scheme. In particular, FIG. 6 is a principle description of an audio encoding/decoding chain.

At the encoding side, the audio signal is compressed by an audio coding scheme (typically exploiting perceptual effects) and Parametric Side Information (PSI) is computed (see encoder 601). The resulting bitstream consisting of coded audio signal and PSI are stored (or transmitted) to the decoder side, where they can be decoded by various decoder instances 620, 621, 622, labeled as "A", "B", etc. in FIG. 6. These decoder instances can differ from each other (e.g., different complexity levels in standard specification, application or implementation restrictions, etc.) [SAOC, SAOC1, SAOC2].

State of the art coding schemes are not capable to adapt the PSI to a specific target application scenario or platform in an efficient way. This can lead into higher (than necessitated) computational complexity at the decoder side or can result in compatibility problems.

SUMMARY

According to an embodiment, an apparatus for adapting input audio information, encoding one or more audio objects, to obtain adapted audio information, wherein the input audio information includes two or more input audio downmix channels and further includes input parametric side information, wherein the adapted audio information includes one or more adapted audio downmix channels and further includes adapted parametric side information, may have: a downmix signal modifier for adapting, depending on adaptation information, the two or more input audio downmix channels to obtain the one or more adapted audio downmix channels, and a parametric side information adapter for adapting, depending on the adaptation information, the input parametric side information to obtain the adapted parametric side information, wherein the adaptation information includes an adaptation matrix, wherein the downmix signal modifier is configured to adapt, depending on the adaptation matrix, the two or more input audio downmix channels to obtain the one or more adapted audio downmix channels, wherein the parametric side information adapter is configured to adapt, depending on the adaptation matrix, the input parametric side information to obtain the adapted parametric side information.

According to another embodiment, an apparatus for generating one or more audio channels from input audio information encoding one or more audio objects may have: an inventive apparatus for adapting the input audio information to obtain adapted audio information, wherein the input audio information includes two or more input audio downmix channels and further includes input parametric side information, wherein the adapted audio information includes one or more adapted audio downmix channels and further includes adapted parametric side information, and a decoder instance for decoding, depending on the adapted parametric side information, the one or more adapted audio downmix channels to obtain the one or more audio channels.

According to another embodiment, a method for adapting input audio information, encoding one or more audio objects, to obtain adapted audio information, wherein the input audio information includes s two or more input audio downmix channels and further includes input parametric side information, wherein the adapted audio information includes one or more adapted audio downmix channels and further includes adapted parametric side information, may have the steps of: adapting, depending on adaptation information, the two or more input audio downmix channels to obtain the one or more adapted audio downmix channels, and adapting, depending on the adaptation information, the input parametric side information to obtain the adapted parametric side information, wherein the adaptation information includes an adaptation matrix, wherein the step of adapting the two or more input audio downmix channels includes s adapting, depending on the adaptation matrix, the two or more input audio downmix channels to obtain the one or more adapted audio downmix channels, wherein the step of adapting the input parametric side information includes adapting, depending on the adaptation matrix, the input parametric side information to obtain the adapted parametric side information.

Another embodiment may have a computer program for implementing the inventive method when being executed by a computer or signal processor.

An apparatus for adapting input audio information, encoding one or more audio objects, to obtain adapted audio information is provided. The input audio information comprises two or more input audio downmix channels and further comprises input parametric side information. The adapted audio information comprises one or more adapted audio downmix channels and further comprises adapted parametric side information.

The apparatus comprises a downmix signal modifier for adapting, depending on adaptation information, the two or more input audio downmix channels to obtain the one or more adapted audio downmix channels.

Moreover, the apparatus comprises a parametric side information adapter for adapting, depending on the adaptation information, the input parametric side information to obtain the adapted parametric side information.

According to an embodiment, the downmix signal modifier may be configured to adapt the two or more input audio downmix channels depending on the adaptation information, such that the number of the one or more adapted audio downmix channels is smaller than the number of the two or more input audio downmix channels.

In an embodiment, the adaptation information may depend on a decoder instance. The downmix signal modifier may be configured to adapt the two or more input audio downmix channels depending on the decoder instance. Here and in the following, the terms "decoder", and "decoder instance" have the same meaning.

According to an embodiment, the decoder instance may be capable of decoding at most a maximum number of downmix channels. The adaptation information may depend on said maximum number of downmix channels. Moreover, the downmix signal modifier may be configured to adapt the two or more input audio downmix channels depending on the adaptation information to obtain the one or more adapted audio downmix channels, such that the number of the one or more adapted downmix channels is equal to said maximum number of downmix channels.

According to an embodiment, the adaptation information may comprise an adaptation matrix ($D_{dmx}^{DSM}$).

In an embodiment, the downmix signal modifier may be configured to adapt, depending on the adaptation matrix ($D_{dmx}^{DSM}$), the two or more input audio downmix channels ($X_{dmx}^{ENC}$) to obtain the one or more adapted audio downmix channels ($X_{dmx}^{DSM}$).

According to an embodiment, the downmix signal modifier may be configured to adapt, depending on the adaptation matrix $D_{dmx}^{DSM}$, the two or more input audio downmix channels $X_{dmx}^{ENC}$ to obtain the one or more adapted audio downmix channels $X_{dmx}^{DSM}$ by applying the formula:

$$X_{dmx}^{DSM}=D_{dmx}^{DSM}X_{dmx}^{ENC}.$$

In an embodiment, the parametric side information adapter may be configured to adapt, depending on the adaptation matrix ($D_{dmx}^{DSM}$), the input parametric side information ($D_{dmx}^{ENC}$) to obtain the adapted parametric side information ($D_{dmx}^{PSI}$).

According to an embodiment, the parametric side information adapter may be configured to adapt, depending on the adaptation matrix $D_{dmx}^{DSM}$, the input parametric side information $D_{dmx}^{ENC}$ to obtain the adapted parametric side information $D_{dmx}^{PSI}$ by applying the formula:

$$D_{dmx}^{PSI}=D_{dmx}^{DSM}D_{dmx}^{ENC}.$$

In an embodiment, the input parametric side information ($D_{dmx}^{enc}$) may indicate an initial downmix matrix, such that by applying the initial downmix matrix ($D_{dmx}^{enc}$) on the one or more audio objects (S), the two or more input audio downmix channels ($X_{dmx}^{enc}$) are obtained. The parametric side information adapter may be configured to determine an adapted downmix matrix ($D_{dmx}^{PSI}$) as the adapted parametric side information, such that by applying the adapted downmix matrix ($D_{dmx}^{PSI}$) on the one or more audio objects (S), the one or more adapted audio downmix channels ($X_{dmx}^{DSM}$) are obtained.

Moreover, according to an embodiment, an apparatus for generating one or more audio channels from input audio information encoding one or more audio objects is provided.

The apparatus for generating the one or more audio channels comprises an apparatus according to one of the above-described embodiments for adapting the input audio information to obtain adapted audio information, wherein the input audio information comprises two or more input audio downmix channels and further comprises input parametric side information, wherein the adapted audio information comprises one or more adapted audio downmix channels and further comprises adapted parametric side information.

Moreover, the apparatus for generating the one or more audio channels comprises a decoder instance, for decoding, depending on the adapted parametric side information, the one or more adapted audio downmix channels to obtain the one or more audio channels.

According to an embodiment, the parametric side information adapter of the apparatus for adapting the input audio information may be configured to receive an input bit stream comprising the input parametric side information. The parametric side information adapter of the apparatus for adapting the input audio information may be configured to adapt the input parametric side information to obtain the adapted parametric side information, and to feed the adapted parametric side information into the decoder instance. The decoder instance may be configured to decode the one or more adapted audio downmix channels depending on the adapted parametric side information.

In another embodiment, the parametric side information adapter of the apparatus for adapting the input audio information may be configured to receive an input bit stream comprising the input parametric side information. The parametric side information adapter of the apparatus for adapting the input audio information may be configured to substitute the input parametric side information within the input bit stream by the adapted parametric side information to obtain a modified bit stream. The parametric side information adapter of the apparatus for adapting the input audio information may be configured to feed the modified bit stream into the decoder instance. Moreover, the decoder instance may be configured to decode the one or more adapted audio downmix channels depending on the modified bit stream.

Furthermore, a method for adapting input audio information, encoding one or more audio objects, to obtain adapted audio information is provided. The input audio information comprises two or more input audio downmix channels and further comprises input parametric side information. The adapted audio information comprises one or more adapted audio downmix channels and further comprises adapted parametric side information. The method comprises:

Adapting, depending on adaptation information, the two or more input audio downmix channels to obtain the one or more adapted audio downmix channels. And:

Adapting, depending on the adaptation information, the input parametric side information to obtain the adapted parametric side information.

Moreover, a computer program for implementing the above-described method when being executed by a computer or signal processor is provided.

BRIEF DESCRIPTION OF THE DRAWINGS

Embodiments of the present invention will be detailed subsequently referring to the appended drawings, in which.

DETAILED DESCRIPTION OF THE INVENTION

Before describing embodiments of the present invention, more background on state-of-the-art-SAOC systems is provided.

Figure 3:
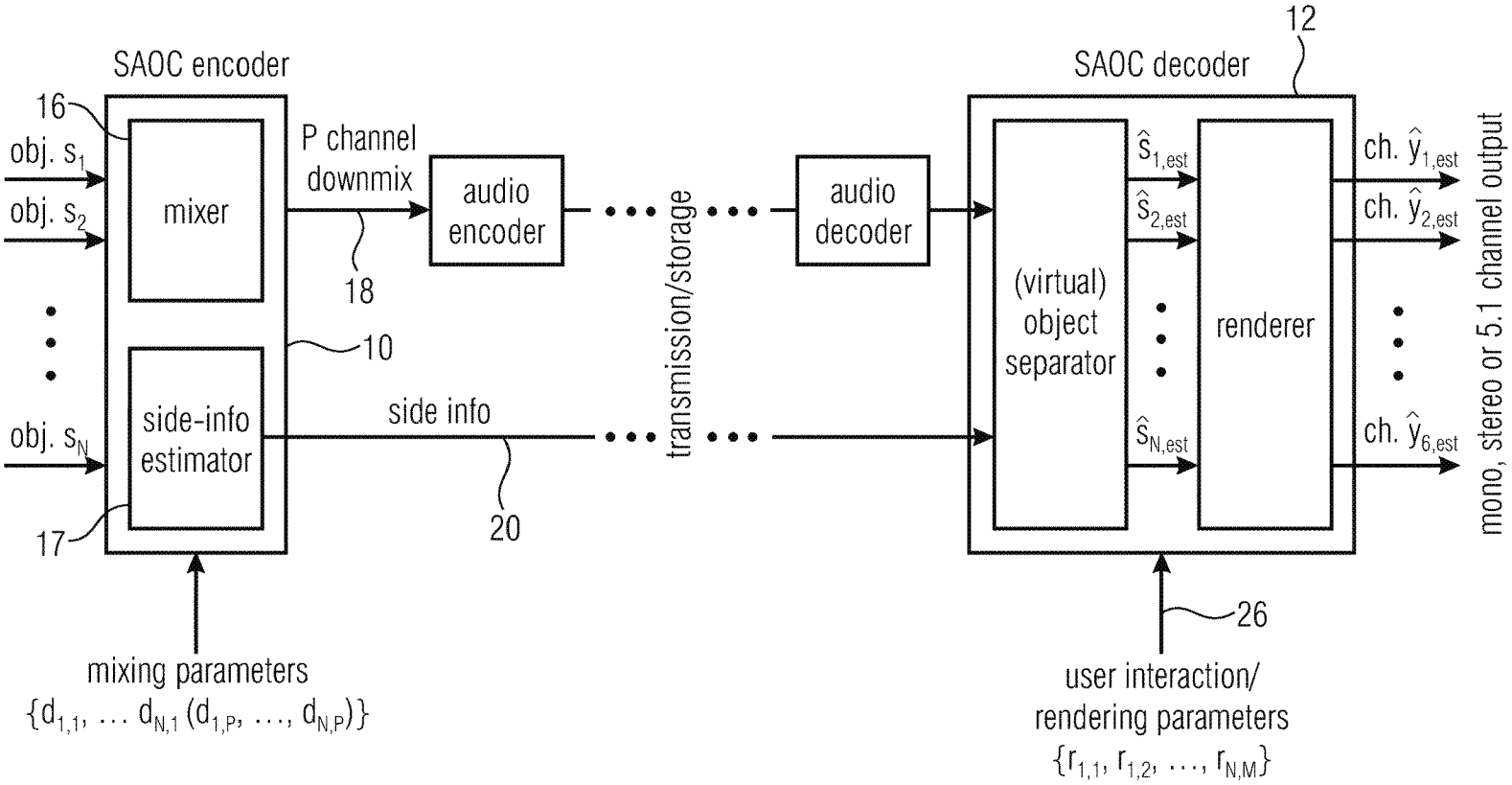
FIG. 3 shows a schematic block diagram of a conceptual overview of an SAOC system.

FIG. 3 shows a general arrangement of an SAOC encoder 10 and an SAOC decoder 12. The SAOC encoder 10 receives as an input N objects, i.e., audio signals $s_1$ to $s_N$. In particular, the encoder 10 comprises a downmixer 16 which receives the audio signals $s_1$ to $s_N$ and downmixes same to a downmix signal 18. Alternatively, the downmix may be provided externally ("artistic downmix") and the system estimates additional side information to make the provided downmix match the calculated downmix. In FIG. 3, the downmix signal is shown to be a P-channel signal. Thus, any mono (P=1), stereo (P=2) or multi-channel (P>2) downmix signal configuration is conceivable.

In the case of a stereo downmix, the channels of the downmix signal 18 are denoted L0 and R0, in case of a mono downmix same is simply denoted L0. In order to enable the SAOC decoder 12 to recover the individual objects $s_1$ to $s_N$, side-information estimator 17 provides the SAOC decoder 12 with side information including SAOC-parameters. For example, in case of a stereo downmix, the SAOC parameters comprise object level differences (OLD), inter-object correlations (IOC) (inter-object cross correlation parameters), downmix gain values (DMG) and downmix channel level differences (DCLD). The side information 20, including the SAOC-parameters, along with the downmix signal 18, forms the SAOC output data stream received by the SAOC decoder 12.

The SAOC decoder 12 comprises an up-mixer which receives the downmix signal 18 as well as the side information 20 in order to recover and render the audio signals $\hat{s}_1$ and $\hat{s}_N$ onto any user-selected set of channels $\hat{y}_1$ to $\hat{y}_M$, with the rendering being prescribed by rendering information 26 input into SAOC decoder 12.

The audio signals $s_1$ to $s_N$ may be input into the encoder 10 in any coding domain, such as, in time or spectral domain. In case the audio signals $s_1$ to $s_N$ are fed into the encoder 10 in the time domain, such as PCM coded, encoder 10 may use a filter bank, such as a hybrid QMF bank, in order to transfer the signals into a spectral domain, in which the audio signals are represented in several sub-bands associated with different spectral portions, at a specific filter bank resolution. If the audio signals $s_1$ to $s_N$ are already in the representation expected by encoder 10, same does not have to perform the spectral decomposition.

Figure 4:
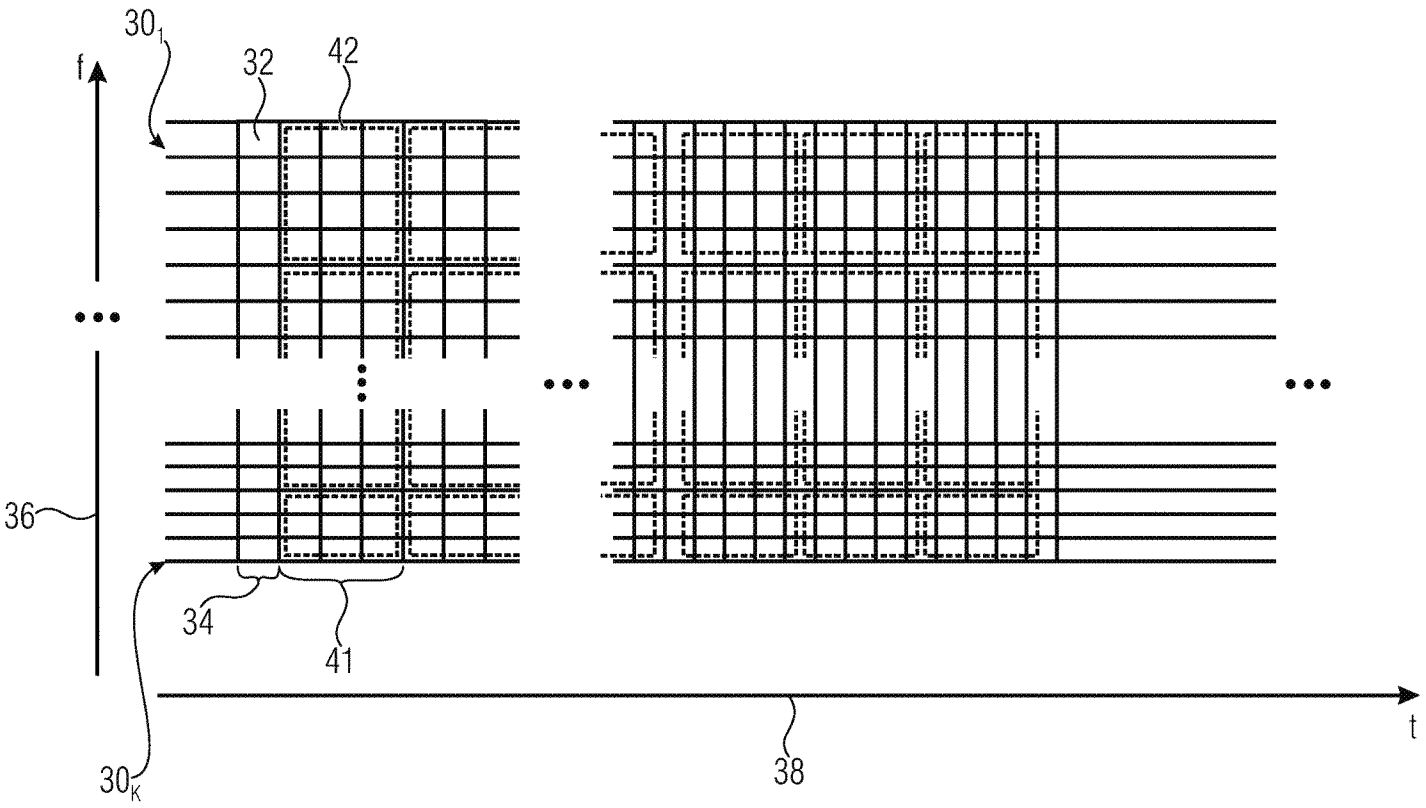
FIG. 4 shows a schematic and illustrative diagram of a temporal-spectral representation of a single-channel audio signal.

FIG. 4 shows an audio signal in the just-mentioned spectral domain. As can be seen, the audio signal is represented as a plurality of sub-band signals. Each sub-band signal $\mathbf{30}_1$ to $\mathbf{30}_K$ consists of a temporal sequence of sub-band values indicated by the small boxes 32. As can be seen, the sub-band values 32 of the sub-band signals $\mathbf{30}_1$ to $\mathbf{30}_K$ are synchronized to each other in time so that, for each of the consecutive filter bank time slots 34, each sub-band $\mathbf{30}_1$ to $\mathbf{30}_K$ comprises exact one sub-band value 32. As illustrated by the frequency axis 36, the sub-band signals $\mathbf{30}_1$ to $\mathbf{30}_K$ are associated with different frequency regions, and as illustrated by the time axis 38, the filter bank time slots 34 are consecutively arranged in time.

As outlined above, side information extractor 17 of FIG. 3 computes SAOC-parameters from the input audio signals $s_1$ to $s_N$. According to the currently implemented SAOC standard, encoder 10 performs this computation in a time/frequency resolution which may be decreased relative to the original time/frequency resolution as determined by the filter bank time slots 34 and sub-band decomposition, by a certain amount, with this certain amount being signaled to the decoder side within the side information 20. Groups of consecutive filter bank time slots 34 may form a SAOC frame 41. Also the number of parameter bands within the SAOC frame 41 is conveyed within the side information 20. Hence, the time/frequency domain is divided into time/frequency tiles exemplified in FIG. 4 by dashed lines 42. In FIG. 4 the parameter bands are distributed in the same manner in the various depicted SAOC frames 41 so that a regular arrangement of time/frequency tiles is obtained. In general, however, the parameter bands may vary from one SAOC frame 41 to the subsequent, depending on the different needs for spectral resolution in the respective SAOC frames 41. Furthermore, the length of the SAOC frames 41 may vary, as well. As a consequence, the arrangement of time/frequency tiles may be irregular. Nevertheless, the time/frequency tiles within a particular SAOC frame 41 typically have the same duration and are aligned in the time direction, i.e., all t/f-tiles in said SAOC frame 41 start at the start of the given SAOC frame 41 and end at the end of said SAOC frame 41.

The side information extractor 17 depicted in FIG. 3 calculates SAOC parameters according to the following formulas. In particular, side information extractor 17 computes object level differences for each object i as $$OLD_i^{l,m} = \frac{\sum_{n\in l}\sum_{k\in m} x_i^{n,k} x_i^{n,k*}}{\max_j\left(\sum_{n\in l}\sum_{k\in m} x_j^{n,k} x_j^{n,k*}\right)}$$

wherein the sums and the indices n and k, respectively, go through all temporal indices 34, and all spectral indices 30 which belong to a certain time/frequency tile 42, referenced by the indices l for the SAOC frame (or processing time slot) and m for the parameter band. Thereby, the energies of all sub-band values $x_i$ of an audio signal or object i are summed up and normalized to the highest energy value of that tile among all objects or audio signals. $x_i^{n,k*}$ denotes the complex conjugate of $x_i^{n,k}$.

Further, the SAOC side information extractor 17 is able to compute a similarity measure of the corresponding time/frequency tiles of pairs of different input objects $s_1$ to $s_N$. Although the SAOC side information extractor 17 may compute the similarity measure between all the pairs of input objects $s_1$ to $s_N$, side information extractor 17 may also suppress the signaling of the similarity measures or restrict the computation of the similarity measures to audio objects $s_1$ to $s_N$ which form left or right channels of a common stereo channel. In any case, the similarity measure is called the inter-object cross-correlation parameter $IOC_{i,j}^{l,m}$. The computation is as follows $$IOC_{i,j}^{l,m} = IOC_{j,i}^{l,m} = \mathrm{Re}\left\{\frac{\sum_{n\in l}\sum_{k\in m} x_i^{n,k} x_j^{n,k*}}{\sqrt{\sum_{n\in l}\sum_{k\in m} x_i^{n,k} x_i^{n,k*} \sum_{n\in l}\sum_{k\in m} x_j^{n,k} x_j^{n,k*}}}\right\}$$

with again indices n and k going through all sub-band values belonging to a certain time/frequency tile 42, i and j denoting a certain pair of audio objects $s_1$ to $s_N$, and Re{ } denoting the operation of discarding the imaginary part of the complex argument.

The downmixer 16 of FIG. 3 downmixes the objects $s_1$ to $s_N$ by use of gain factors applied to each object $s_1$ to $s_N$. That is, a gain factor $d_i$ is applied to object i and then all thus weighted objects $s_1$ to $s_N$ are summed up to obtain a mono downmix signal, which is exemplified in FIG. 3 if P=1. In another example case of a two-channel downmix signal, depicted in FIG. 3 if P=2, a gain factor $d_{1,i}$ is applied to object i and then all such gain amplified objects are summed in order to obtain the left downmix channel L0, and gain factors $d_{2,i}$ are applied to object i and then the thus gain-amplified objects are summed in order to obtain the right downmix channel R0. A processing that is analogous to the above is to be applied in case of a multi-channel downmix (P>2).

This downmix prescription is signaled to the decoder side by means of downmix gains $DMG_i$ and, in case of a stereo downmix signal, downmix channel level differences $DCLD_i$.

The downmix gains are calculated according to:

$$DMG_i = 20\log_{10}(d_i+\varepsilon), \text{(mono downmix)},$$

$$DMG_i = 10\log_{10}(d_{1,i}^2+d_{2,i}^2+\varepsilon), \text{(stereo downmix)},$$

where ε is a small number such as $10^{-9}$.

For the DCLDs the following formula applies:

$$DCLD_i = 20\log_{10}\left(\frac{d_{1,i}}{d_{2,i}+\varepsilon}\right).$$

In the normal mode, downmixer 16 generates the downmix signal according to:

$$(L0) = (d_i)\begin{pmatrix} s_1 \\ \vdots \\ s_N \end{pmatrix}$$

for a mono downmix, or $$\begin{pmatrix} L0 \\ R0 \end{pmatrix} = \begin{pmatrix} d_{1,i} \\ d_{2,i} \end{pmatrix}\begin{pmatrix} s_1 \\ \vdots \\ s_N \end{pmatrix}$$

for a stereo downmix, respectively.

Thus, in the abovementioned formulas, parameters OLD and IOC are a function of the audio signals and parameters DMG and DCLD are a function of d. By the way, it is noted that d may be varying in time and in frequency.

Thus, in the normal mode, downmixer 16 mixes all objects $s_1$ to $s_N$ with no preferences, i.e., with handling all objects $s_1$ to $s_N$ equally.

At the decoder side, the upmixer performs the inversion of the downmix procedure and the implementation of the "rendering information" 26 represented by a matrix R (in the literature sometimes also called A) in one computation step, namely, in case of a two-channel downmix $$\begin{pmatrix} \hat{y}_1 \\ \vdots \\ \hat{y}_M \end{pmatrix} = RED^*(DED^*)^{-1}\begin{pmatrix} L0 \\ R0 \end{pmatrix},$$

where matrix E is a function of the parameters OLD and IOC, and the matrix D contains the downmixing coefficients as $$D = \begin{pmatrix} d_{1,1} & \dots & d_{1,N} \\ \vdots & \ddots & \vdots \\ d_{P,1} & \dots & d_{P,N} \end{pmatrix}.$$

The matrix E is an estimated covariance matrix of the audio objects $s_1$ to $s_N$. In current SAOC implementations, the computation of the estimated covariance matrix E is typically performed in the spectral/temporal resolution of the SAOC parameters, i.e., for each (l,m), so that the estimated covariance matrix may be written as $E^{l,m}$. The estimated covariance matrix $E^{l,m}$ is of size N×N with its coefficients being defined as $$e_{i,j}^{l,m} = \sqrt{OLD_i^{l,m} OLD_j^{l,m}}\, IOC_{i,j}^{l,m}.$$

Thus, the matrix $E^{l,m}$ with $$E^{l,m} = \begin{pmatrix} e_{1,1}^{l,m} & \dots & e_{1,N}^{l,m} \\ \vdots & \ddots & \vdots \\ e_{N,1}^{l,m} & \dots & e_{N,N}^{l,m} \end{pmatrix}$$

has along its diagonal the object level differences, i.e., $e_{i,j}^{l,m} = OLD_i^{l,m}$ for i=j, since $OLD_i^{l,m} = OLD_j^{l,m}$ and $IOC_{i,j}^{l,m} = 1$ for i=j. Outside its diagonal the estimated covariance matrix E has matrix coefficients representing the geometric mean of the object level differences of objects i and j, respectively, weighted with the inter-object cross correlation measure $IOC_{i,j}^{l,m}$.

Figure 5:
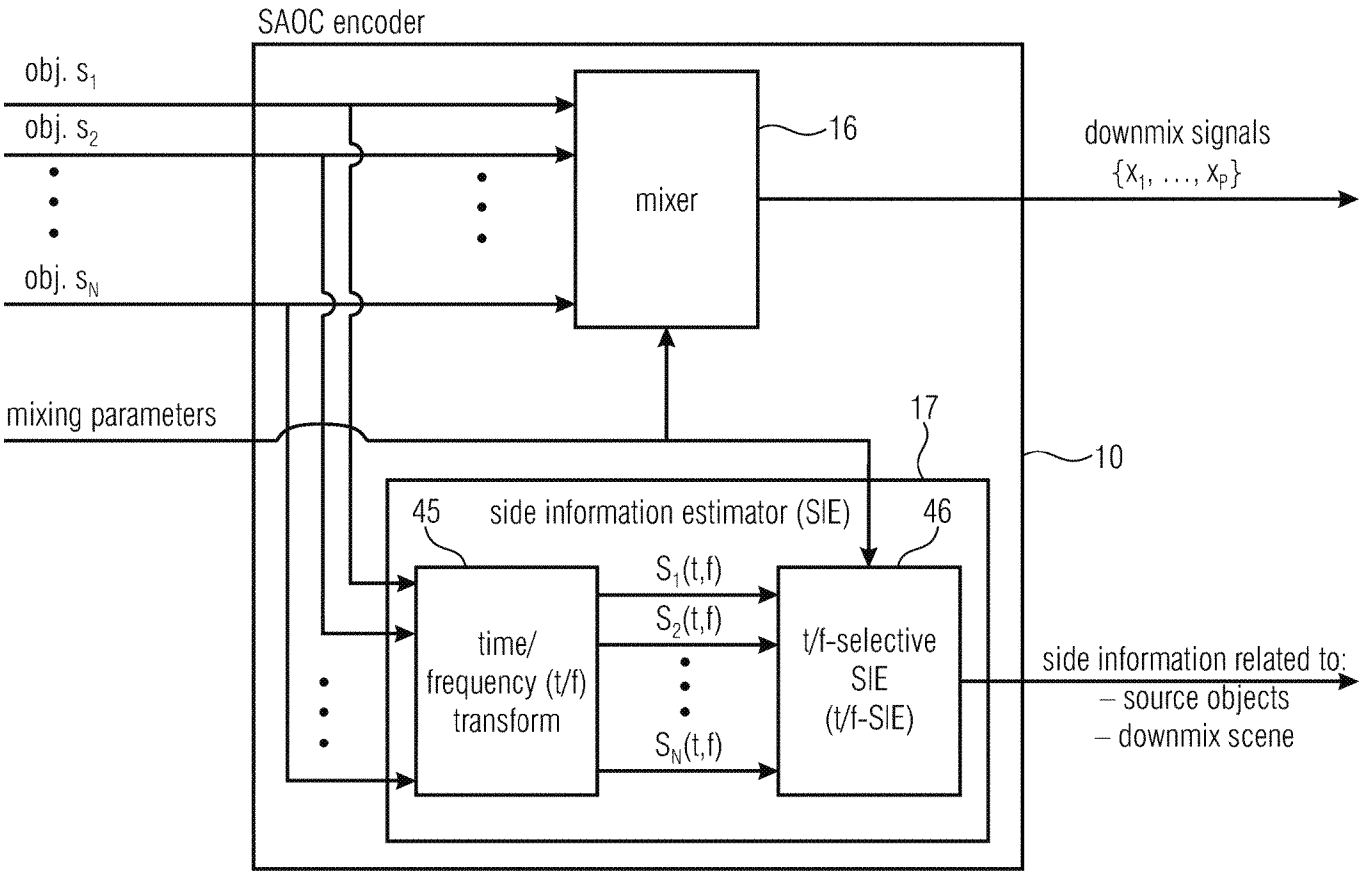
FIG. 5 shows a schematic block diagram of a time-frequency selective computation of side information within an SAOC encoder, FIG. 6 schematically depicts the principle of an audio encoding/decoding scheme.
Figure 6:
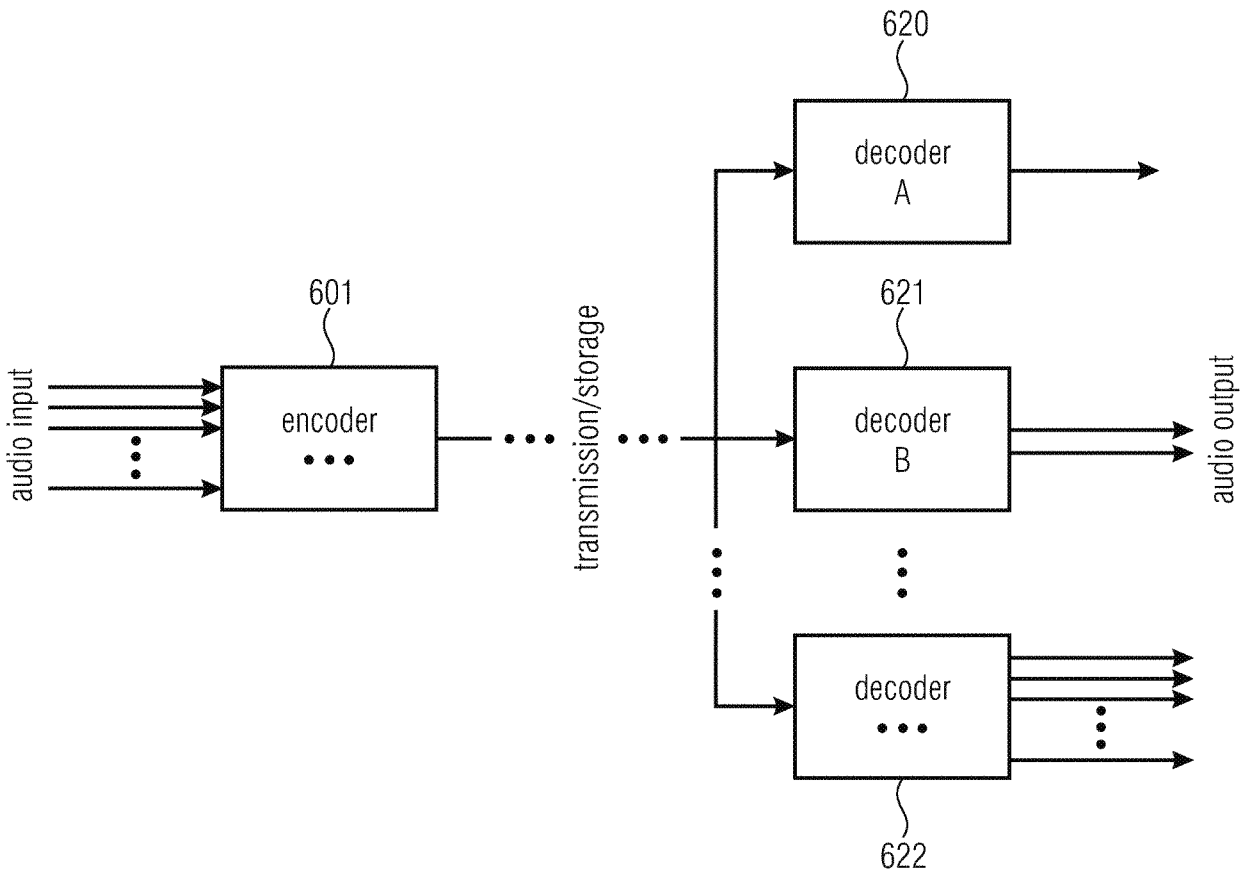

FIG. 5 displays one possible principle of implementation on the example of the Side-information estimator (SIE) as part of a SAOC encoder 10. The SAOC encoder 10 comprises the mixer 16 and the side-information estimator (SIE) 17. The SIE conceptually consists of two modules: One module 45 to compute a short-time based t/f-representation (e.g., STFT or QMF) of each signal. The computed short-time t/f-representation is fed into the second module 46, the t/f-selective-Side-Information-Estimation module (t/f-SIE). The t/f-SIE module 46 computes the side information for each t/f-tile. In current SAOC implementations, the time/frequency transform is fixed and identical for all audio objects $s_1$ to $s_N$. Furthermore, the SAOC parameters are determined over SAOC frames which are the same for all audio objects and have the same time/frequency resolution for all audio objects $s_1$ to $s_N$, thus disregarding the object-specific needs for fine temporal resolution in some cases or fine spectral resolution in other cases.

In the following, embodiments of the present invention are described.

Figure 1:
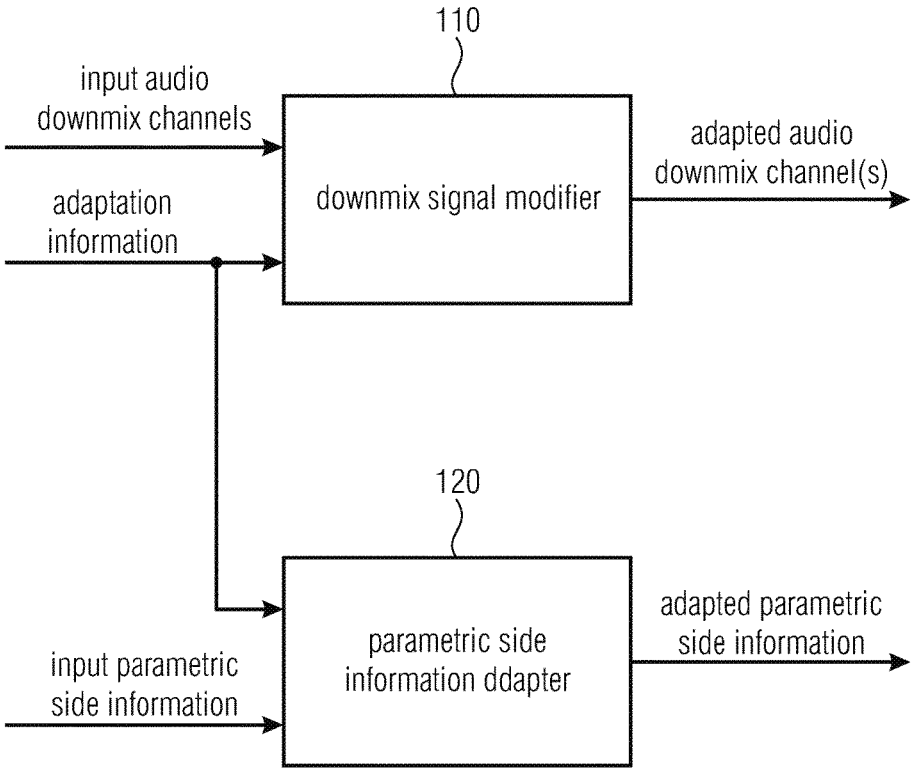
FIG. 1 illustrates an apparatus for adapting input audio information, encoding one or more audio objects, to obtain adapted audio information according to an embodiment.

FIG. 1 illustrates an apparatus for adapting input audio information, encoding one or more audio objects, to obtain adapted audio information according to an embodiment.

The input audio information comprises two or more input audio downmix channels and further comprises input parametric side information. The adapted audio information comprises one or more adapted audio downmix channels and further comprises adapted parametric side information.

The apparatus comprises a downmix signal modifier (DSM) 110 for adapting, depending on adaptation information, the two or more input audio downmix channels to obtain the one or more adapted audio downmix channels.

Moreover, the apparatus comprises a parametric side information adapter (PSIA) 120 for adapting, depending on the adaptation information, the input parametric side information to obtain the adapted parametric side information.

Figure 2:
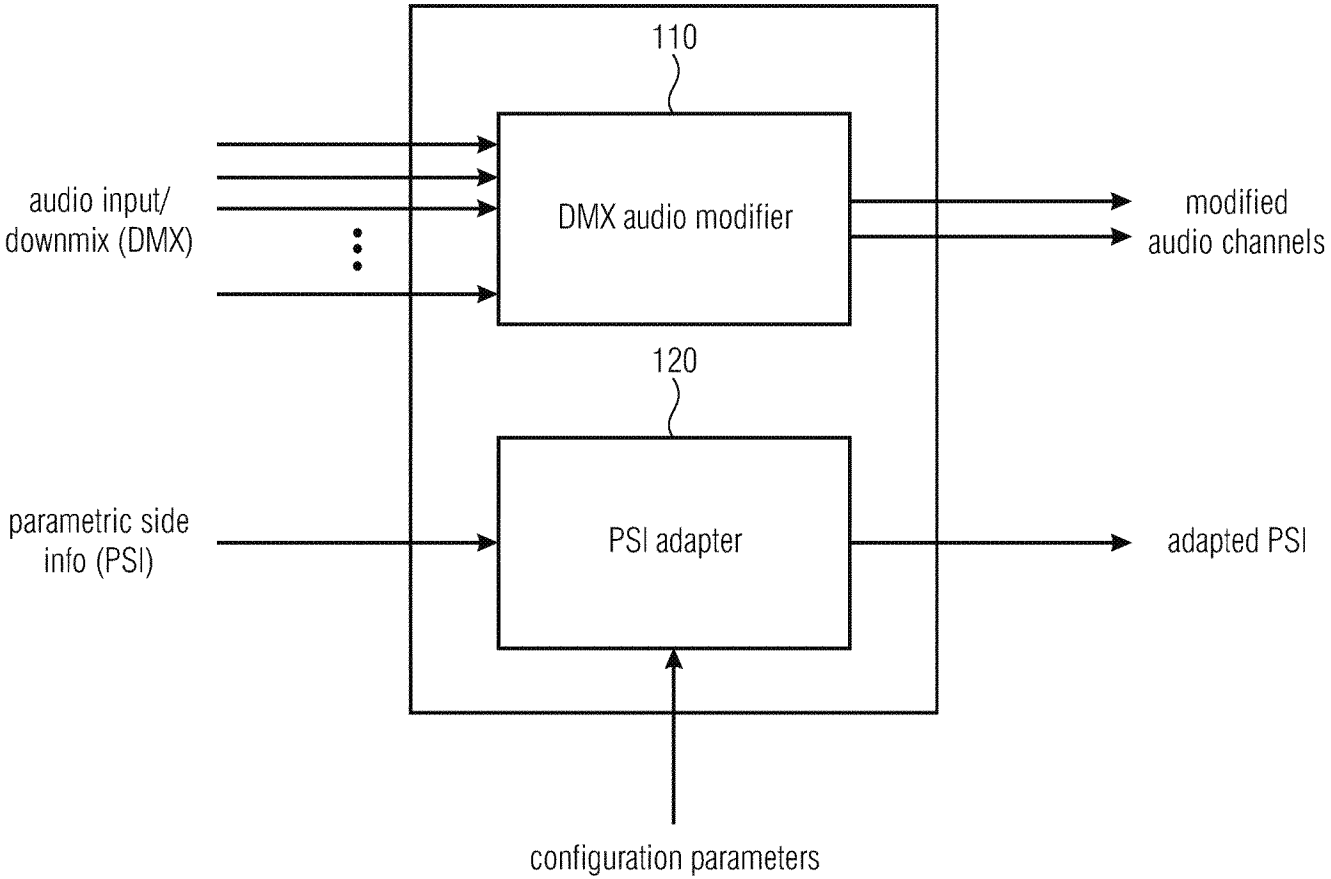
FIG. 2 illustrates an apparatus for adapting input audio information, encoding one or more audio objects, to obtain adapted audio information according to another embodiment.

FIG. 2 illustrates an apparatus for adapting input audio information, encoding one or more audio objects, to obtain adapted audio information according to another embodiment.

In an embodiment, the adaptation information may depend on a decoder instance, and the downmix signal modifier 110 may be configured to adapt the two or more input audio downmix channels depending on the decoder instance.

For example, the downmix signal modifier 110 of FIG. 2 adapts the downmix to the capabilities of the particular decoder instance.

According to an embodiment, the downmix signal modifier 110 may be configured to adapt the two or more input audio downmix channels depending on the adaptation information, such that the number of the one or more adapted audio downmix channels is smaller than the number of the two or more input audio downmix channels.

For example, in the embodiment of FIG. 2, the downmix signal modifier 110 reduces the number of the transport/downmix channels.

E.g., 22.2 input audio downmix channels (=24 input audio downmix channels) may be reduced to 7.1 adapted audio downmix channels (=8 adapted audio downmix channels).

Or, for example, 5.1 input audio downmix channels (=6 input audio downmix channels) are reduced to 2.0 adapted audio downmix channels (=2 adapted audio downmix channels).

Or, for example, 2 input audio downmix channels are reduced to 1 adapted audio downmix channel.

Various other combinations of input audio downmix channels and adapted audio downmix channels are possible According to an embodiment, the decoder instance may be capable of decoding at most a maximum number of downmix channels. The adaptation information may depend on said maximum number of downmix channels. Moreover, the downmix signal modifier 110 may be configured to adapt the two or more input audio downmix channels depending on the adaptation information to obtain the one or more adapted audio downmix channels, such that the number of the one or more adapted downmix channels is equal to said maximum number of downmix channels.

For example, the downmix signal modifier 110 of FIG. 2 converts the downmix to the audio signal that corresponds to the maximal supported output channel configuration of the particular decoder instance.

According to an embodiment, the adaptation information may, for example, comprise an adaptation matrix ($D_{dmx}^{DSM}$).

The parametric side information adapter 120 may, e.g., adapt the PSI to correspond to the modified downmix in order to decrease the computational complexity for the decoder, and to reduce the corresponding data bitstream size/bitrate without producing negative influence on the decoder output audio quality.

For example, the PSIA 120 modifies the corresponding PSI bitstream substituting the information representing the initial downmix matrix by the updated information describing the resulting downmix (accounting for the DSM modifications) to correspond to the particular specification of the decoder.

For example, an SAOC encoder provides the stereo downmix signal $X_{dmx}^{ENC}$ resulting from application of the encoder downmix matrix $D_{dmx}^{ENC}$ to the input audio object signals S:

$$X_{dmx}^{ENC}=D_{dmx}^{ENC}S.$$

According to an embodiment, the downmix signal modifier 110 may be configured to adapt, depending on the adaptation matrix $D_{dmx}^{DSM}$, the two or more input audio downmix channels $X_{dmx}^{ENC}$ to obtain the one or more adapted audio downmix channels $X_{dmx}^{DSM}$. In an embodiment, this is realized, for example, by applying the formula $X_{dmx}^{DSM}=D_{dmx}^{DSM}X_{dmx}^{ENC}$.

For example, in an embodiment, where it is assumed that the particular SAOC decoder instance supports only mono downmix (e.g. SAOC Low Delay profile/Level 1). In this case, the DSM 110 converts the stereo downmix $X_{dmx}^{ENC}$ to the mono signal $X_{dmx}^{DSM}$ using a predefined downmix matrix $D_{dmx}^{DSM}$ as follows:

$$X_{dmx}^{DSM}=D_{dmx}^{DSM}X_{dmx}^{ENC}.$$

According to an embodiment, the parametric side information adapter 120 may be configured to adapt, depending on the adaptation matrix $D_{dmx}^{DSM}$, the input parametric side information $D_{dmx}^{ENC}$ to obtain the adapted parametric side information $D_{dmx}^{PSI}$. In an embodiment, this may, for example, be realized by applying the formula: $D_{dmx}^{PSI}=D_{dmx}^{DSM}D_{dmx}^{ENC}$.

For example, according to an embodiment, the PSIA 120 parses the corresponding PSI bitstream; extracts information that describes the downmix matrix $D_{dmx}^{ENC}$; substitutes these data by updated information that describes the new downmix matrix $D_{dmx}^{PSI}$:

$$D_{dmx}^{PSI}=D_{dmx}^{DSM}D_{dmx}^{ENC}.$$

Thus, according to an embodiment, the input parametric side information ($D_{dmx}^{enc}$) may indicate an initial downmix matrix, such that by applying the initial downmix matrix ($D_{dmx}^{enc}$) on the one or more audio objects (S), the two or more input audio downmix channels ($X_{dmx}^{enc}$) are obtained. The parametric side information adapter may be configured to determine an adapted downmix matrix ($D_{dmx}^{PSI}$) as the adapted parametric side information, such that by applying the adapted downmix matrix ($D_{dmx}^{PSI}$) on the one or more audio objects (S), the one or more adapted audio downmix channels ($X_{dmx}^{DSM}$) are obtained.

In an embodiment, the PSIA formats the new modified bitstream or directly passes these parameters to the decoder.

This encoding and decoding process performed by the PSIA can also include conversion of different downmix matrix representation formats (e.g. polar- to Cartesian-coordinate system, etc.).

This described function of the PSIA can solve potential compatibility issues and reduce the size of the corresponding bitstream.

Figure 7:
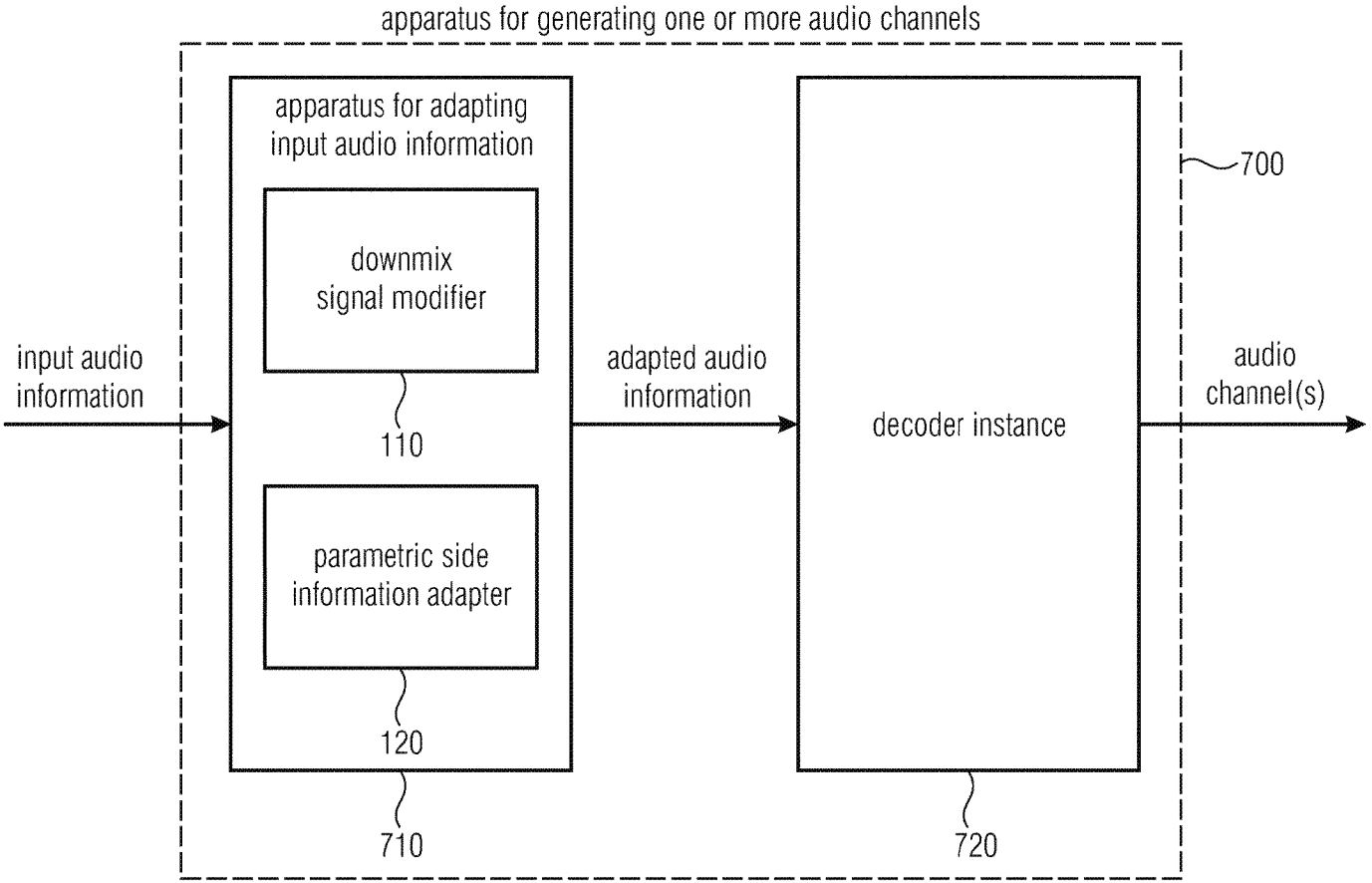
FIG. 7 illustrates an apparatus for generating one or more audio channels from input audio information encoding one or more audio objects according to an embodiment.

FIG. 7 illustrates an apparatus 700 for generating one or more audio channels from input audio information encoding one or more audio objects according to an embodiment.

The apparatus 700 for generating the one or more audio channels comprises an apparatus 710 according to one of the above-described embodiments for adapting the input audio information to obtain adapted audio information. The input audio information comprises two or more input audio downmix channels and further comprises input parametric side information. The adapted audio information comprises one or more adapted audio downmix channels and further comprises adapted parametric side information.

The apparatus 710 according to one of the above-described embodiments for adapting the input audio information comprises a downmix signal modifier 110 and a parametric side information adapter 120.

Moreover, the apparatus 700 for generating the one or more audio channels comprises a decoder instance 720, for decoding, depending on the adapted parametric side information, the one or more adapted audio downmix channels to obtain the one or more audio channels.

According to an embodiment, the parametric side information adapter 120 of the apparatus 710 for adapting the input audio information may be configured to receive an input bit stream comprising the input parametric side information. The parametric side information adapter 120 of the apparatus 710 for adapting the input audio information may be configured to adapt the input parametric side information to obtain the adapted parametric side information, and to feed the adapted parametric side information into the decoder instance 720. The decoder instance 720 may be configured to decode the one or more adapted audio downmix channels depending on the adapted parametric side information.

In another embodiment, the parametric side information adapter 120 of the apparatus 710 for adapting the input audio information may be configured to receive an input bit stream comprising the input parametric side information. The parametric side information adapter 120 of the apparatus 710 for adapting the input audio information may be configured to substitute the input parametric side information within the input bit stream by the adapted parametric side information to obtain a modified bit stream. The parametric side information adapter 120 of the apparatus 710 for adapting the input audio information may be configured to feed the modified bit stream into the decoder instance 720. Moreover, the decoder instance 720 may be configured to decode the one or more adapted audio downmix channels depending on the modified bit stream.

Figure 8:
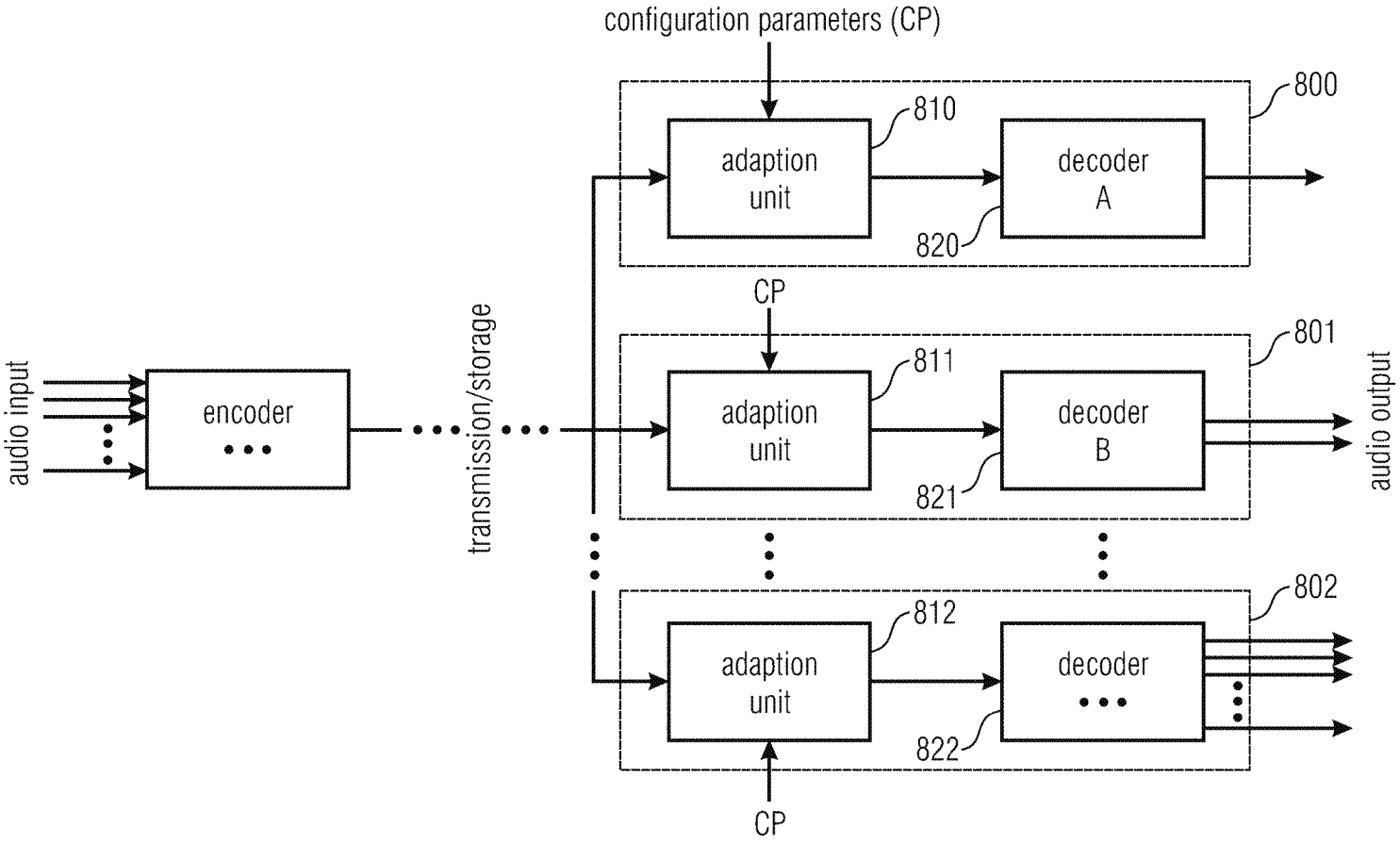
FIG. 8 illustrates a joint PSIA application within an encoding/decoding scheme according to an embodiment.
Figure 9:
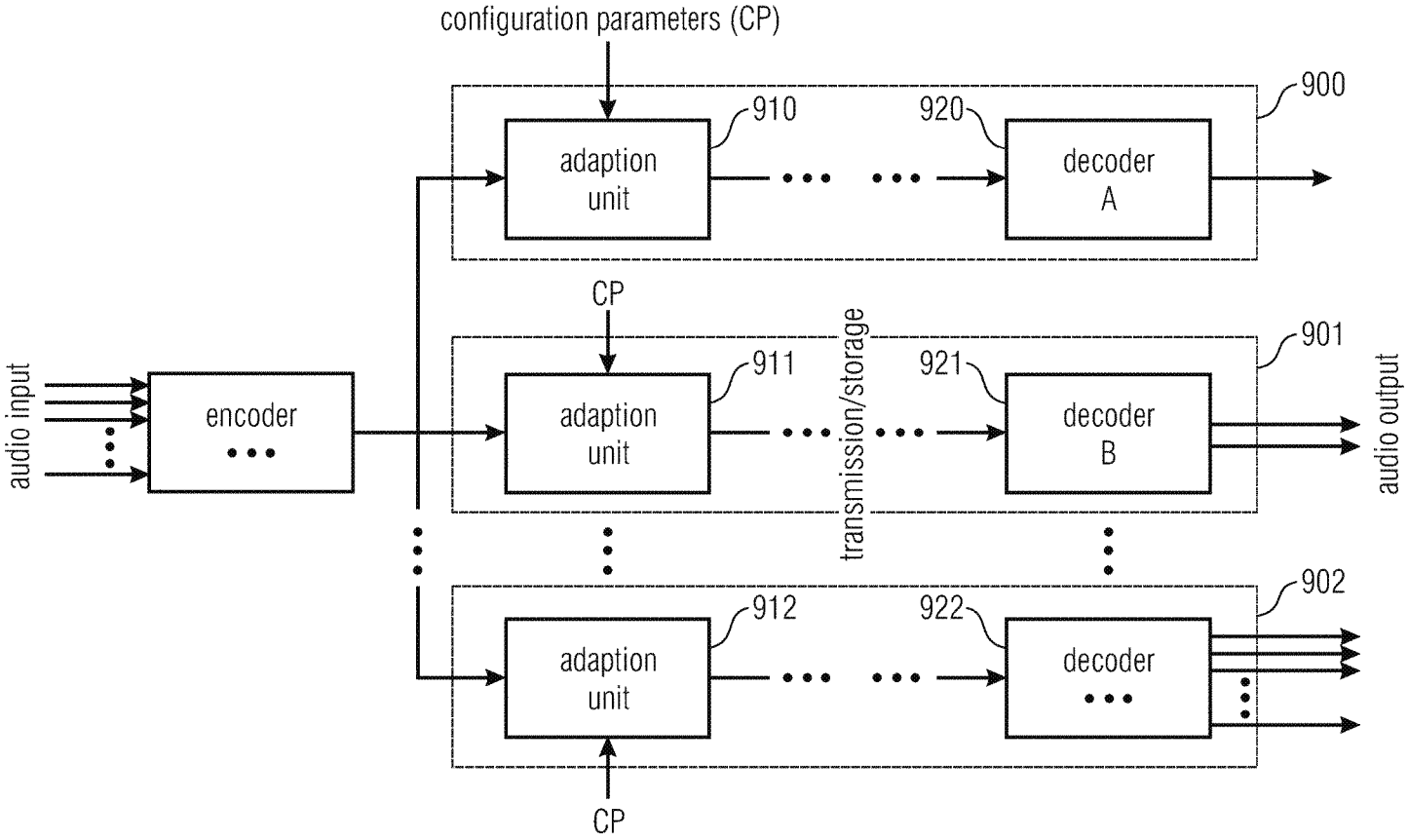
FIG. 9 illustrates disjoint PSIA application within an encoding/decoding scheme according to an embodiment.

FIGS. 8 and 9 depict two possibilities to incorporate the apparatus for adapting input audio information into the decoding processing chain.

In particular, FIG. 8 illustrates a joint PSIA application within an encoding/decoding scheme according to an embodiment.

FIG. 8 illustrates a plurality of apparatuses 800, 801, 802 for generating one or more audio channels from input audio information encoding one or more audio objects, wherein the apparatus 800 for generating one or more audio channels comprises an apparatus 810 for adapting input audio information and a decoder instance 820, wherein the apparatus 801 for generating one or more audio channels comprises an apparatus 811 for adapting input audio information and a decoder instance 821, and wherein the apparatus 802 for generating one or more audio channels comprises an apparatus 812 for adapting input audio information and a decoder instance 822. It should be noted that, for example, the apparatus 800 for generating one or more audio channels, comprising the apparatus 810 for adapting input audio information and the decoder instance 820, does not have to be realized as a single hardware unit 800, but instead may be realized by two separate units 810, 820 being connected by a wire or being wirelessly connected.

The joint (integrated) implementation of the apparatus for adapting input audio information can be realized in order to reduce computational complexity for decoding (see FIG. 8). In addition, this allows implementing a non-quantized (non-coded) interface between the apparatus for adapting input audio information and the decoder. This can be relevant in particular for mobile application devices for reducing power consumption.

FIG. 9 illustrates disjoint PSIA application within an encoding/decoding scheme according to an embodiment.

In particular, FIG. 9 illustrates a plurality of apparatuses 900, 901, 902 for generating one or more audio channels from input audio information encoding one or more audio objects, wherein the apparatus 900 for generating one or more audio channels comprises an apparatus 910 for adapting input audio information and a decoder instance 920, wherein the apparatus 901 for generating one or more audio channels comprises an apparatus 911 for adapting input audio information and a decoder instance 921, and wherein the apparatus 902 for generating one or more audio channels comprises an apparatus 912 for adapting input audio information and a decoder instance 922. It should be noted that, for example, the apparatus 900 for generating one or more audio channels, comprising the apparatus 910 for adapting input audio information and the decoder instance 920, does not have to be realized as a single hardware unit 900, but instead may be realized by two separate units 910, 920 being connected by a wire or being wirelessly connected.

The disjoint (separated) implementation of the apparatus for adapting input audio information can be realized in order to reduce the corresponding data bitstream size/bitrate, see FIG. 9. This can be relevant in particular for mobile application devices with limited storage and transmission capacity and Multi-point Control Unit (MCU) systems with narrow data transition channels.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM, or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[MPS] ISO/IEC 23003-1:2007, MPEG-D (MPEG audio technologies), Part 1: MPEG Surround, 2007

[BCC] C. Faller and F. Baumgarte, "Binaural Cue Coding—Part II: Schemes and applications," IEEE Trans. on Speech and Audio Proc., vol. 11, no. 6, November 2003

[JSC] C. Faller, "Parametric Joint-Coding of Audio Sources", 120th AES Convention, Paris, 2006

[SAOC1] J. Herre, S. Disch, J. Hilpert, O. Hellmuth: "From SAC To SAOC—Recent Developments in Parametric Coding of Spatial Audio", 22nd Regional UK AES Conference, Cambridge, UK, April 2007

[SAOC2] J. Engdegård, B. Resch, C. Falch, O. Hellmuth, J. Hilpert, A. Hölzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam 2008

[SAOC] ISO/IEC, "MPEG audio technologies—Part 2: Spatial Audio Object Coding (SAOC)," ISO/IEC JTC1/SC29/WG11 (MPEG) International Standard 23003-2.

[ISS1] M. Parvaix and L. Girin: "Informed Source Separation of underdetermined instantaneous Stereo Mixtures using Source Index Embedding", IEEE ICASSP, 2010

[ISS2] M. Parvaix, L. Girin, J.-M. Brossier: "A watermarking-based method for informed source separation of audio signals with a single sensor", IEEE Transactions on Audio, Speech and Language Processing, 2010

[ISS3] A. Liutkus and J. Pinel and R. Badeau and L. Girin and G. Richard: "Informed source separation through spectrogram coding and data embedding", Signal Processing Journal, 2011

[ISS4] A. Ozerov, A. Liutkus, R. Badeau, G. Richard: "Informed source separation: source coding meets source separation", IEEE Workshop on Applications of Signal Processing to Audio and Acoustics, 2011

[ISS5] Shuhua Zhang and Laurent Girin: "An Informed Source Separation System for Speech Signals", INTERSPEECH, 2011

[ISS6] L. Girin and J. Pinel: "Informed Audio Source Separation from Compressed Linear Stereo Mixtures", AES 42nd International Conference: Semantic Audio, 2011

The invention claimed is:

1. An audio encoder for encoding one or more audio object signals to obtain one or more second downmix channels and second parametric side information, wherein the apparatus comprises:

a first audio signal encoding unit configured for downmixing the one or more audio object signals to obtain two or more first audio downmix channels and to obtain first parametric side information, a downmix signal modifier configured for applying an adaptation matrix on the two or more first audio downmix channels to acquire the one or more second audio downmix channels, wherein the adaptation matrix comprises at least two rows, and wherein the adaptation matrix comprises at least two columns, and a parametric side information adapter configured for applying said adaptation matrix on the first parametric side information to acquire the second parametric side information, wherein the audio encoder is configured for outputting the one or more second audio downmix channels and the second parametric side information so that the one or more audio object signals are decodable using the one or more second audio downmix channels, and using the second parametric side information, wherein the apparatus is implemented using a hardware apparatus or using a computer or using a combination of a hardware apparatus and a computer.

2. An audio encoder according to claim 1, wherein the first parametric side information indicates an initial downmix matrix, such that by applying the initial downmix matrix on the one or more audio object signals, the two or more first audio downmix channels are acquired, and wherein the parametric side information adapter is configured to determine an adapted downmix matrix as the second parametric side information, such that by applying the adapted downmix matrix on the one or more audio object signals, the one or more second audio downmix channels are acquired.

3. An audio encoder according to claim 1, wherein the downmix signal modifier is configured to adapt the two or more first audio downmix channels using the adaptation matrix, such that the number of the one or more second audio downmix channels is smaller than the number of the two or more first audio downmix channels.

4. An audio encoder according to claim 1, wherein the adaptation matrix depends on a decoder instance, and wherein the downmix signal modifier is configured to adapt the two or more first audio downmix channels depending on the decoder instance.

5. An audio encoder according to claim 4, wherein the decoder instance is capable of decoding at most a maximum number of downmix channels, wherein the adaptation matrix depends on said maximum number of downmix channels, and wherein the downmix signal modifier is configured to adapt the two or more first audio downmix channels depending on the adaptation matrix to acquire the one or more second audio downmix channels, such that the number of the one or more second audio downmix channels is equal to said maximum number of downmix channels.

6. An audio encoder according to claim 1, wherein the downmix signal modifier is configured to adapt, depending on the adaptation matrix $D_{dmx}^{DSM}$, the two or more first audio downmix channels $X_{dmx}^{ENC}$ to acquire the one or more second audio downmix channels $X_{dmx}^{DSM}$ by applying the formula:

$$X_{dmx}^{DSM}=D_{dmx}^{DSM}X_{dmx}^{ENC}.$$

7. An audio encoder according to claim 1, wherein the parametric side information adapter is configured to adapt, depending on the adaptation matrix $D_{dmx}^{DSM}$, the first parametric side information $D_{dmx}^{ENC}$ to acquire the second parametric side information $D_{dmx}^{PSI}$ by applying the formula:

$$D_{dmx}^{PSI}=D_{dmx}^{DSM}D_{dmx}^{ENC}.$$

8. A system for generating one or more audio channels from first audio information encoding one or more audio object signals, wherein the apparatus comprises:

an audio encoder according to claim 1 for adapting the first audio information to acquire second audio information, wherein the first audio information comprises two or more first audio downmix channels and further comprises first parametric side information, wherein the second audio information comprises one or more second audio downmix channels and further comprises second parametric side information, and an audio decoder for decoding, depending on the second parametric side information, the one or more second audio downmix channels to acquire the one or more audio channels.

9. A system according to claim 8, wherein the parametric side information adapter of the apparatus according to claim 1 is configured to adapt the first parametric side information to acquire the second parametric side information, and to feed the second parametric side information into the audio decoder, and wherein the audio decoder is configured to decode the one or more second audio downmix channels depending on the second parametric side information.

10. A system according to claim 8, wherein the parametric side information adapter of the apparatus according to claim 1 is configured to feed a bit stream comprising the second parametric side information into the audio decoder, and wherein the audio decoder is configured to decode the one or more second audio downmix channels depending on the bit stream.

11. A method for audio encoding for encoding one or more audio object signals to obtain one or more second downmix channels and second parametric side information, wherein the method comprises:

downmixing the one or more audio object signals to obtain two or more first audio downmix channels and to obtain first parametric side information, applying an adaptation matrix on the two or more first audio downmix channels to acquire the one or more second audio downmix channels, wherein the adaptation matrix comprises at least two rows, and wherein the adaptation matrix comprises at least two columns, and applying said adaptation matrix on the first parametric side information to acquire the second parametric side information, outputting the one or more second audio downmix channels and the second parametric side information so that the one or more audio object signals are decodable using the one or more second audio downmix channels, and using the second parametric side information, wherein the method is performed using a hardware apparatus or using a computer or using a combination of a hardware apparatus and a computer.

12. A method according to claim 11, wherein the first parametric side information indicates an initial downmix matrix, such that by applying the initial downmix matrix on the one or more audio object signals, the two or more first audio downmix channels are acquired, and wherein adapting the first parametric side information comprises determining an adapted downmix matrix as the second parametric side information, such that by applying the adapted downmix matrix on the one or more audio object signals, the one or more second audio downmix channels are acquired.

13. A non-transitory computer-readable medium comprising a computer program for implementing, when being executed by a computer or signal processor, a method for audio encoding for encoding one or more audio object signals to obtain one or more second downmix channels and second parametric side information, wherein the method comprises: downmixing the one or more audio object signals to obtain two or more first audio downmix channels and to obtain first parametric side information, applying an adaptation matrix on the two or more first audio downmix channels to acquire the one or more second audio downmix channels, wherein the adaptation matrix comprises at least two rows, and wherein the adaptation matrix comprises at least two columns, and applying said adaptation matrix on the first parametric side information to acquire the second parametric side information, outputting the one or more second audio downmix channels and the second parametric side information so that the one or more audio object signals are decodable using the one or more second audio downmix channels, and using the second parametric side information.

* * * * *